US009650696B2

(12) United States Patent
Maffeis et al.

(10) Patent No.: US 9,650,696 B2
(45) Date of Patent: May 16, 2017

(54) METHOD FOR PRODUCING AN ALUMINIUM ALLOY FOAM BY MOULDING

(71) Applicant: CONSTELLIUM ISSOIRE, Paris (FR)

(72) Inventors: Michel Maffeis, Ussel (FR); Francois Trincat, Four (FR)

(73) Assignee: CONSTELLIUM ISSOIRE, Issoire (FR)

( * ) Notice: Subject to any disclaimer, the term of this patent is extended or adjusted under 35 U.S.C. 154(b) by 100 days.

(21) Appl. No.: 14/405,983

(22) PCT Filed: Jun. 20, 2013

(86) PCT No.: PCT/FR2013/000156

§ 371 (c)(1),
(2) Date: Dec. 5, 2014

(87) PCT Pub. No.: WO2014/001657

PCT Pub. Date: Jan. 3, 2014

(65) Prior Publication Data

US 2015/0184269 A1 Jul. 2, 2015

(30) Foreign Application Priority Data

Jun. 29, 2012 (FR) ..... 12 01846

(51) Int. Cl.

| | |
|---|---|
| ***B22C 9/10*** | (2006.01) |
| ***B22D 21/00*** | (2006.01) |
| ***B22D 25/00*** | (2006.01) |
| ***B22D 29/00*** | (2006.01) |
| ***C22C 1/08*** | (2006.01) |
| ***C22C 21/02*** | (2006.01) |
| ***C22C 21/06*** | (2006.01) |
| ***B22D 18/04*** | (2006.01) |

(52) U.S. Cl.

CPC ..... *C22C 1/08* (2013.01); *B22C 9/10* (2013.01); *B22D 18/04* (2013.01); *B22D 21/007* (2013.01); *B22D 25/005* (2013.01); *B22D 29/003* (2013.01); *C22C 21/02* (2013.01); *C22C 21/06* (2013.01); *C22C 2001/082* (2013.01)

(58) Field of Classification Search

CPC ..... B22C 9/10; B22D 18/04; B22D 21/007; B22D 25/005; B22D 29/003; C22C 1/08; C22C 2001/082

USPC ..... 164/6, 15, 23, 30, 132, 369

See application file for complete search history.

(56) References Cited

U.S. PATENT DOCUMENTS

| | | | |
|---|---|---|---|
| 3,111,396 | A | 11/1963 | Ball |
| 4,235,277 | A | 11/1980 | Aizawa et al. |
| 2010/0021758 | A1 | 1/2010 | Mortensen et al. |

FOREIGN PATENT DOCUMENTS

| | | | |
|---|---|---|---|
| FR | 2921281 | A1 | 3/2009 |

OTHER PUBLICATIONS

International Search Report mailed Oct. 31, 2013, corresponding to International Patent Application PCT/FR2013/000156.

Banhart J: "Properties and applications of cast aluminium sponges", Advanced Engineering Materials, Wiley VCH Verlag, Weinheim, DE, vol. 2, No. 4, Jan. 1, 2000 (Jan. 1, 2000), pp. 188-191.

Berg A et al: "Application of Aluminium Sponges in the Adsorption Refrigeration Engineering", Proceedings of Int. Conf. on Porous Metals and Metallic Foams, Jan. 1, 2008 (Jan. 1, 2008). pp. 493-496.

Ma L et al: "Cellular structure controllable aluminium foams produced by high pressure infiltration process", Scripta Materialia, Elsevier, Amsterdam, NL, vol. 41. No. 7, Aug. 30, 1999 (Aug. 30, 1999). pp. 785-789.

San Marchi C et al: "2.6 Infiltration and the Replication Process for Producing Metal Sponges", Jan. 1, 2002 (Jan. 1, 2002). Handbook of Cellular Metals: Production, Processing, Applications, Wiley—VCH Verlag, Weinheim: DE. pp. 43-56.

Grote F et al: "Giesstechnische Herstellung Offenporiger Metallschwamme Mittels Mineralischer Platzhalter". Materialwissenschaft und Werkstofftechnik, Wiley—V C H Verlag GmbH & Co. Kgaa, DE, vol. 31, Jan. 1, 2000 (Jan. 1, 2000), pp. 415-418.

Ashby M F et al: "Metal Foams: A Design Guide. 3 cover pages and Chapter 2 pp. 6-23 and Chapter 19 pp. 239-241", Jan. 1, 2000 (Jan. 1, 2000).

Gaillard Y et al: "Les Mousses D'Aluminium CTIF Par Voie de Fonderie//CTIF's Aluminium Foams Made by Foundry Processes", Fonderie, Fondeur D'Aujourd'Hui, Editions Techniques des Industries de la Fonderie, Sevres. FR, No. 250. Dec. 1, 2005 (Dec. 1, 2005), pp. 13-24.

*Primary Examiner* — Kevin P Kerns

(74) *Attorney, Agent, or Firm* — Ladas & Parry LLP

(57) ABSTRACT

A method for producing an aluminum alloy foam wherein an aluminum alloy, in molten form, infiltrates the interstices of a preform of silicon elastomer elements, by means of a conventional molding process, typically a low-pressure process, followed by the elimination of the preform broken down into silica powder during the molding cycle and/or an additional baking cycle.

20 Claims, No Drawings

METHOD FOR PRODUCING AN ALUMINIUM ALLOY FOAM BY MOULDING

This application is a 371 of PCT/FR2013/000156, filed on Jun. 20, 2013, which claims priority to French Application No. 1201846, filed Jun. 29, 2012.

FIELD OF THE INVENTION

The invention concerns the field of the manufacture, by moulding, of highly porous metal materials, known as metal foams or sponges or microcellular metal materials or open celled metal foams, or characterised by a porosity of at least 10% and typically 60% to 80%.

Many methods for obtaining this type of material has been developed at the present time and are described in particular in "Metal Foams; A Design Guide", M F Ashby, A G Evans, N A Fleck, L J Gibson, J W Hutchinson, H N G Wadley, 2000, Butterworth-Heinemann, [J Banhart, Progress in Materials Science 46 (2001) 559-632], http://www.metal-foam.net/.

More precisely, the invention concerns a method for manufacturing this type of aluminium foam by moulding, that is to say by infiltration of the interstices in a destructible preform or core, in this case consisting of elements made from silicone elastomer.

The products may be used, in replacement for materials with a honeycomb or thin structure, in the manufacture of industrial heat exchangers in general or for the automobile or nuclear fields, or passive exchangers for cooling electrical or power electronic circuits, lighting by LED diodes, acoustic installation, or energy absorption in particular for impacts in the automobile field, etc.

PRIOR ART

Many references exist, relating to the manufacture of "aluminium foams" by moulding.

The various methods used for this purpose are recapitulated in particular in [M F Ashby, A G Evans, N A Fleck, L J Gibson, J W Hutchinson, H N G Wadley "Metal Foams: A Design Guide" Butterworth-Heinemann, Boston, (2000)], [J Banhart, Progress in Materials Science 46 (2001) 559-632], [Y Conde, J-F Depois, R Goodall, A Marmottant, L Salvo, C San Marchi & A Mortensen, Advanced Engineering Materials 8(9) 795-803 (2006)].

They include various methods:

One of them, based on "lost pattern precision moulding", is described in [Y Yamada, K Shimojima, Y Sakaguchi, M Mabuchi, N Nakamura, T Asahina, T Mukai, H Kanahashi & K Higashi, Journal of Materials Science Letters, 18 (1999) 1477-1480]. It is also known by the term replication method. It consists of covering a crosslinked foam, typically made from polyurethane, with a refractory-product slip that is then dried and heated in order to consolidate the mould and eliminate the polyurethane precursor. The metal is then cast in the mould thus formed, which is then destroyed conventionally.

J Banhart, in [Progress in Materials Science 46 (2001) 559-632] refers to a method in which a preform is produced from sand agglomerated by a binder that decomposes under the effect of heat during infiltration thereof by the liquid metal and solidification thereof, which allows its subsequent "de-coring".

The "Fraunhofer Institute" in Bremen describes a method according to which a preform made from polymer granules would be infiltrated in moulding of the "external pressure" type, typically by squeeze casting, with an aluminium alloy, after which the polymer preform would be eliminated by thermal action. http://www.ifarn.fraunhofer.de/index.php-?seite=/2801/leichtbauwerkstoffe/offenporoese-strukturen/&lanc=en This reference is cited by the "Ecole Polytechnique Fédéral de Lausanne" in its application WO 2008/099014.

However, all the tests carried out by the applicant using granules of cellulose acetate butyrate (CAB), epoxide (EP), polyamide (PA), polyethylene (PE), phenol formaldehyde (PF), polymethyl methacrylate (PMMA), polypropylene (PP), polytetrafluoroethylene (PTFE), polyvinyl chloride (PVC) or polyvinylidene fluoride (PVDF) and attempting infiltration by conventional casting of the "low-pressure" type thus proved to be vain, because of the melting of the polymer material.

A Berg, W Maysenholder and M Haesche of the "Fraunhofer Institute", in "Noise Reduction by Open-Pore Aluminium Foam" (2003), report experimental productions of foam samples made from $AlSi_9Cu_3$ by infiltration, in moulding of the "sub-pressure" type 250 bar, of preforms of sintered polystyrene balls. After machining, the polymer is eliminated from the samples by heat treatment of 2 hours at 400° C. An alternative is however proposed for the polystyrene granules, in this case balls of salt.

The patent FR 2 921 281 of the "Centre technique des Industries de la Fonderie" (CTIF) describes a method in which the preform is produced from balls of salt or kaolin, agglomerated by a binder typically of polyurethane that decomposes during the infiltration by the liquid metal and during solidification thereof. The balls are then eliminated by the action of a solvent.

This method is however limitative because of the size and form of the balls, their necessarily isotropic distribution, the relatively slow speed of dissolution of the preform by solvent, and also the tricky aspect of its use, in particular in an industrial production context.

The "Ecole Polytechnique Fédéral de Lausanne", in its application WO 2008/099014 and its corresponding patent EP 2 118 328, describes a derived method in which the preform is manufactured by mixing particles of ground salt, a thermodegradable organic binder, typically flour of ground carbohydrate grains, and a wetting agent, fashioning of this product referred to as "salt paste" in an aerated preform with open porous space, followed by evaporation of the wetting agent and curing in order to decompose the binder and then harden the preform at a temperature of 400°-500° C., and then the infiltration. The preform is next eliminated by means of a solvent.

This method has the drawbacks of a step of manufacturing the preform that is relatively tedious, requiring pressing during forming/fashioning, which limits the accessible grain shapes, the risk of formation of agglomerates that are not visible during fashioning, because of the wetting agent, the elimination of which cannot be total, and the ambient moisture, and the need for evaporation and baking of the tricky pyrolysis type.

Moreover, the preform obtained is relatively fragile, which makes it difficult to handle, in particular for placing in the mould, and limits the dimensions accessible.

In addition, evacuation of the preform by solvent also proves to be a problem, particularly in a context of industrial production, and recycling of the salt is a necessity, having regard to environmental constraints and costs, but it also gives rise to additional investment and production costs.

Moreover, because of this use of salt, a residual chloride content is generally appreciable on the "aluminium foam", which has an unfavourable effect on the corrosion resistance of the product. This content may be reduced to an acceptable level, but at the cost of suitable rinsing of the foam, with obviously an effect on the cost thereof.

Finally, the form and distribution of the porosities in the foam obtained are relatively isotropic and not very controllable.

Stated Problem

The present invention sets out to afford a solution to the various aforementioned problems by allowing:

1) easy manufacture of the preform solely from granules and a thermodestructible binder, or even without binder, 2) obtaining a preform that is sufficiently strong to make it easy to handle and to obtain larger sizes of foam than through the methods of the prior art, with the possibility of optionally assembling several preforms, 3) the obtaining of an isotropic or anisotropic open porosity that is perfectly controllable, 4) the possibility of inserting in the preform, during manufacture thereof, metal tubes, typically intended to serve as heat exchanger tubes, but also for example made from glass of the PYREX® glass type, or "cores" to create orifices or other empty shapes in the foam, 5) the destruction of the preform during infiltration/solidification, total or almost total, that is to say requiring only rapid subsequent stoving, of the preform into an easily dischargeable powder, 6) the possibility of using a relatively standard widespread moulding method such as "low pressure" casting in a sand or permanent mould.

Subject Matter of the Invention

The subject matter of the invention is a method for manufacturing an aluminium alloy foam, that is to say a material with open cells having a porosity typically from 60% to 80%, consisting essentially of the infiltration with the liquid aluminium alloy of the interstices of a preform consisting essentially (that is to say more than 50% and preferentially more than 80%) of elements made from silicone elastomer, characterised in that it comprises the following steps:

a) manufacture of the elements constituting the preform, typically by extrusion through a die and cutting, typically by means of a granulator, into portions of silicone elastomer, b) agglomeration of said elements, typically by mixing by means of a mixer in the presence of a binder and forming in a tool of the "core box" moulding type, or by direct clamping in said core box or in a press forming tool, c) natural or forced polymerisation by stoving at a temperature typically from 50° C. to 100° C., d) removal of the preform from the box, e) storage in ambient air or in an oven typically between 80° and 150° C., to evacuate the solvents, f) placing of the preform in a conventional sand or metal mould, g) casting of the aluminium alloy in the mould, typically by a method of the "low pressure" type, that is to say comprising an overpressure typically of 700 mbar to 1.5 bar, preferably from 700 mbar to 1.0 bar, at a temperature typically of 800° to 820° C., h) removal from the mould of the assembly obtained, composed of the aluminium and silicone foam more or less decomposed into silica powder, i) optionally end of decomposition of the silicone by stoving at a temperature of around 400° to 450° C. and discharge of the silica powder, typically by manual knocking out or vibration and/or blowing, optionally by water under pressure.

According to a particular embodiment, said silicone elastomer elements are formed in substantially spherical balls before the agglomeration step b).

To do this, the extruded portions, after cutting by means of a granulator, are rounded in a forming machine, typically between two moving plates. The elements constituting the preform preferably have an circumscribed outside diameter of 2 to 10 mm. This means, in the case of slender elements of the rod, tube or cylinder type, the circumscribed outside diameter perpendicular to the length.

According to another also preferential embodiment, they have a length of 2 to 10 mm.

According to a variant of the method, the agglomeration of the elements constituting the preform is carried out by means of a binder of the liquid silicone type as a proportion of 1% to 3% expressed as a percentage by mass.

According to another variant, the agglomeration of the elements constituting the preform is carried out by means of a binder of the liquid polyurethane resin type at a proportion of 2% to 4% expressed as a percentage by mass.

It should also be noted that it is entirely possible to agglomerate the elements constituting the preform, in particular when it is a case of balls, without any binder, by simple clamping in a press tool.

According to the most usual embodiment, the density of the preform obtained is between 0.5 and 0.8.

According to a particularly advantageous embodiment, the agglomeration step b) comprises the placing of one or more tubes, typically made from aluminium alloy, for use of the "tube plus foam" assembly in the production of tube-type heat exchangers, or made from glass of the PYREX® glass type, for use of the product obtained in particular in the medical field.

Preferentially, the preform is heated to a temperature typically of 150° to 250° C. before placing in the mould.

Finally, preferentially, the preforms, and the aluminium alloy foam obtained, have a minimum size of 50 mm×50 mm and a maximum size of 350 mm×350 mm in respective thicknesses of 10 to 100 mm and 15 to 80 mm.

DESCRIPTION OF THE INVENTION

The invention is based on the finding made by the applicant that silicone elastomer, well known to persons skilled in the art since it is used for producing tubes or cylinders as precursors of air conveying channels in moulds or cores, used themselves in aluminium alloy moulding, withstood the casting of said aluminium alloys without melting, that is to say at temperatures of the order of magnitude of 800° C., the metal solidifying in contact therewith, before decomposing essentially into silica powder under the effect of the heat produced during the casting and solidification.

This material has therefore appeared to be particularly suited to the production of destructible preforms or cores instead of the salt or kaolin or salt paste ball preforms of the prior art for manufacturing aluminium foam by infiltration of aluminium alloy in the interstices left free in said preform, solidification and elimination of the silica powder.

To this end, a silicone elastomer, for example known under the references SI 50 to 80 from the company "Plastelec" and preferably SI 70, with a hardness of 70 Shore, is used as the base material.

It is formed, for example by extrusion, into elongate elements in very varied shapes, that is to say cylinders, tubes, with star or polygonal cross sections, solid or tubular, rods, etc.

The circumscribed outside diameters of these elongate elements, that is to say with a cross section substantially perpendicular to the extrusion axis, are typically but not exclusively from 2 to 10 mm.

Said elements are then cut, for example by means of a granulator, into portions with a length, typically, but not exclusively, from 2 to 10 mm, which will be referred to as elements constituting the preform.

They may at this stage be used as they stand for the following step or fashioned, in particular in the case of non-hollow elements, in the form of balls, that is to say rounded, for example in a forming machine, that is to say, most usually, between two moving plates.

Said constituent elements, optionally in the form of balls, can then be, according to a variant of the invention, agglomerated as they stand in a low-pressure clamping tool of the "core box" type.

The polymerisation is then carried out naturally at ambient temperature or forced temperature by stoving at a temperature of typically 50° to 100° C.

Another variant of the invention consists of mixing said elements, for example in a mixer of the plug mill type, in the presence of a thermodegradable organic binder. The latter may in particular be of the polyurethane type, for example of the "Isocure" type from Ashland, at a proportion typically, but not exclusively, of 2% to 4% as a percentage by weight, or of the liquid silicone type, for example "RTV" with a component from the company "Plastelec", at a proportion typically, but not exclusively, of 1% to 3% as a percentage by mass.

The mixture is next placed for example in a tool of the core box type with a clamping pressure that is conventional for this type of tool, and the polymerisation is then carried out, as above, naturally at ambient temperature or forced by stoving at a temperature typically of 50° to 100° C., preferably 80° C., for half an hour to three quarters of an hour.

It should be noted that, before or during the placing in the clamping tool, other elements may be introduced among the elements constituting the preform, such as for example aluminium alloy (or other) tubes, which proves to be particularly advantageous in the context of the subsequent manufacture of tube-type heat exchangers, or made from glass of the PYREX® glass type, for applications in the medical field.

It is also possible to introduce, among the elements constituting the preform, cores made from agglomerated moulding sand or other preferably thermodegradable material in order to produce in the foam orifices or other "empty" shapes, that is to say free from metal.

The preform is then extracted from the forming/clamping tool in order to evacuate the solvents, in ambient air for a few hours or in an oven, typically between 80° and 150°, for half an hour to two hours.

The preform is then ready for the operation of moulding and infiltration with the liquid aluminium alloy, which is preferably carried out by "low-pressure" casting, the overpressure of liquid metal obtained by this method, typically 700 mbar to 1.5 bar at the end of a rise ramp of one to two seconds, facilitating the penetration of the alloy in the interstices of the preform.

Before it is placed in the mould, which may be of the "permanent metal" type or of the "destructible sand" type or mixed, the preform may be preheated, at a temperature typically of 150° to 250° C.

Casting of the "low pressure" type is then proceeded with in a conventional fashion.

The alloy usually used is of the $AlSi_7Mg_{0.6}$ type but any other type of moulding alloy having good castability can be used.

In the first case, the casting temperature is typically 800° to 820° C. The tube and feed system are filled and then the pressure-rise ramp, typically from 700 mbar to 1.5 bar, and preferentially from 700 mbar to 1 bar, is applied with a time generally of one to two seconds.

The part obtained is then extracted, either by simple removal from the mould in the case of a metal mould, or by destruction of the mould on a vibrating grid, an operation known to persons skilled in the art as knocking out.

At this stage the deburring and dressing or machining of the faces of the part can be carried out.

An additional decomposition of the silicone residues into silica powder can also be carried out at a temperature of around 400° to 450° C. if it is not wished to await the natural decomposition during cooling of the part or if the decomposition is not complete at the end thereof.

The final discharge of the silica powder generally takes place by vibration and blowing compressed air, optionally by means of pressurised water.

It should be noted that this method perfectly meets the stated problem and has numerous advantages compared with the prior art:

The manufacture of the preform is completely easy and the latter is sufficiently strong to make it easier to handle, making it possible to obtain larger dimensions of foam than by the methods or the prior art.

It is moreover possible to assemble several preforms, for example by adhesive bonding, in order to obtain foams with a larger size.

Depending on the organisation of the elements constituting the preform and the choice and any mixing thereof, it is possible to obtain an isotropic or anisotropic open porosity, and this in a perfectly controlled fashion.

Inserting, in the preform during manufacture thereof, tubes made from aluminium alloy, typically intended to serve as heat exchanger tubes, but also for example made from glass of the PYREX® glass type, or cores, is entirely possible, whereas the method of manufacturing the preforms of the prior art and/or the need for a pyrolysis step, as in the case of the salt paste, at 500° C., compromise this type of operation.

The destruction of the preform as a powder, during the infiltration/solidification or requiring only subsequent quick stoving, is also a highly appreciable advantage compared with the preforms of the prior art for which this step is often very detrimental.

Finally, the moulding method used, by "low-pressure" casting, is entirely standard and widespread, without any special adaptation.

In its details, the invention will be better understood by means of the following examples, which do not however have any limitative character.

EXAMPLES

Example 1

The silicone elastomer known by the reference SI 70, with a hardness of 70 Shore, from the company "Plastelec", was used as the base material.

It was extruded into cylindrical tubes with outside diameter of 3 mm and inside diameter 1.7 mm.

The elements constituting the preform were obtained by cutting by means of a granulator, portions with a length of 3 mm.

The elements were mixed with a binder of the liquid silicone type, in this case "RTV" with a component from the company "Plastelec", at a proportion of 2.2% expressed as a percentage by mass, that is to say 40 g of binder for 1.6 kg of hollow cylindrical granules.

They were then placed in the cavity of a core box with dimensions of 233 mm×233 mm×40 mm, where they occupied the entire space.

The polymerisation was effected in ambient air, with removal from the box after 3 hours.

The preform obtained was stoved for 2 hours at 150° C. to discharge the solvents.

The density of the preform obtained, of dimensions 233 mm×233 mm×40 mm, was 0.73.

The preform was preheated to 150° C. and placed in a sand mould, the cavity of which had substantially the same dimensions.

The $AlSi_7Cu_{0.6}$ alloy was cast in "low pressure" mode at 815° C., with filling of the tube and feed system, and then the mould was filled during the final pressure rise of 791 mbar, in 1.6 s.

After solidification and cooling, the mould was knocked out on a vibrating grid, the part deburred, and the faces machined, and then the remaining silica powder was removed by vibration and final blowing with compressed air.

The foam obtained had dimensions of 218 mm×218 mm×40 mm and a weight of 1.5 kg.

Its calculated density was 0.8 and its open porosity 71%.

Example 2

The same silicone elastomer as before was used.

It was extruded in rods, that is to say solid cylinders, with a diameter of 5 mm.

They were cut as before into portions with a length of 5 mm.

The elements were mixed with a binder of the liquid silicone type, in this case "RTV" with a component from "Plastelec", at a proportion of 2% expressed as a percentage by mass, that is to say 30 g of binder for 1.6 kg of solid cylindrical granules. They were then placed in the cavity of a core box with dimensions of 233 mm×233 mm×40 mm, where they occupied the entire space.

Two cylindrical moulding cores, made from agglomerated sand, with a diameter of 35 mm and a length of 40 mm, that is to say over the entire thickness of the preform, and two aluminium alloy tubes of the AA 5086 type with an outside diameter of 12 mm and a thickness of 0.8 mm, in a direction perpendicular to the cores, were also placed at the heart of the assembly.

Polymerisation was partly effected in an oven for hour at 80° C., then at ambient temperature, with removal from the box with separation after a total of 2 hours.

The preform obtained was not stoved.

The density of the preform obtained, of dimensions 233 mm×233 mm×40 mmm, was 0.73.

The preform was preheated to 150° C. and placed in a sand mould, the cavity of which had substantially the same dimensions.

The $AlSi_7Cu_{0.6}$ alloy was cast in "low pressure" mode at 809° C., with filling of the tube and feed system, and then the mould was filled during the final pressure rise of 720 mbar, in 1.4 s.

After solidification and cooling, the mould was knocked out on a vibrating grid, the part deburred, and the faces machined, and then the remaining silica powder was removed by vibration and final blowing with compressed air.

The foam obtained had dimensions of 225 mm×225 mm×40 mm and a weight of 1.4 kg.

Its calculated density was 0.7 and its open porosity 74%.

There are then the two orifices with a diameter of approximately 35 mm passing through the foam throughout its entire thickness, left by the cores, as well as the aluminium alloy tubes, in this case in a direction perpendicular to the cores, and over the entire length of the foam.

The invention claimed is:

1. A method for manufacturing an aluminium alloy foam having open cells with a porosity of from 60% to 80%, wherein the method comprises:

extruding a silicone elastomer through a die to form silicone elastomer elements;

cutting each of the extruded silicone elastomer elements into portions of silicone elastomer elements, each of said portions having a similar length;

agglomerating the portions of silicone elastomer elements;

polymerizing the agglomerated portions of silicone elastomer elements in a moulding tool to form a preform;

removing the preform from the moulding tool;

storing the preform at a temperature of from 80° C. to 150° C.;

placing the preform into a mould;

casting an aluminium alloy in the mould at a temperature of from 800° C. to 820° C., and at a pressure of from 700 mbar to 1.5 bar, to allow the alloy to penetrate into interstices of the preform, thereby forming an aluminium alloy foam and silica powder; and removing the aluminium alloy foam from the mould.

2. The method according to claim 1, wherein the portions are formed as substantially spherical balls before the agglomeration step.

3. The method according to claim 1, wherein the silicone elastomer elements extruded from the die have a circumscribed outside diameter of from 2 mm to 10 mm.

4. The method according to claim 1, wherein the portions have a length of from 2 mm to 10 mm.

5. The method of claim 1, wherein the portions are agglomerated by mixing the portions in the presence of a binder, and forming the preform in a core box mould.

6. The method according to claim 5, wherein the binder is a liquid silicone binder.

7. The method according to claim 6, wherein the liquid silicone binder is used in an amount of from 1% to 3% expressed as a percentage by mass.

8. The method according to claim 5, wherein the binder is a liquid polyurethane resin binder.

9. The method according to claim 8, wherein the liquid polyurethane resin binder is used in an amount of from 2% to 4% expressed as a percentage by mass.

10. The method according to claim 1, wherein the preform has a density of from 0.5 to 0.8.

11. The method according to claim 1, further comprising introducing a tube into the preform during the agglomerating step.

12. The method according to claim 11, wherein the tube is made from aluminium alloy or borosilicate glass.

13. The method according to claim 1, wherein the preform is preheated to a temperature of from 150° C. to 250° C. before being placed into the mould.

14. The method according to claim 1, wherein the preform has a minimum size of 50 mm×50 mm, and a thickness of from 10 to 100 mm, and a maximum size of 350 mm×350 mm, and a thickness of from 15 to 80 mm.

15. The method of claim 1, wherein the polymerizing step is a natural polymerizing step or a forced polymerizing step.

16. The method of claim 15, wherein the forced polymerizing step is carried out by stoving at a temperature of from 50° C. to 100° C.

17. The method of claim 1, wherein the portions are agglomerated by directly clamping in a core box mould tool or in a press forming tool.

18. The method of claim 1, comprising casting the aluminium alloy at a pressure of from 700 mbar to 1.0 bar.

19. The method of claim 1, further comprising stoving aluminium alloy foam at a temperature of from 400° C. to 450° C., and discharging the silica powder.

20. The method of claim 1, wherein the silica powder is discharged by a member selected from the group consisting of manual knocking out, vibrating, blowing, water under pressure, and a combination thereof.

* * * * *